US006165523A

United States Patent [19]

Story

[11] Patent Number: 6,165,523

[45] Date of Patent: Dec. 26, 2000

[54] INJECTOR BOTTLE CAP ASSEMBLY

[76] Inventor: Douglas Story, RD #1, Box 346, Brackney, Pa. 18812

[21] Appl. No.: 09/299,283

[22] Filed: Apr. 26, 1999

[51] Int. Cl.[7] ..... B65D 25/08; B65D 51/28; B65D 41/00

[52] U.S. Cl. ..... 426/112; 426/115; 426/120; 426/111; 206/222; 215/228; 215/250

[58] Field of Search ..... 426/120, 117, 426/112, 115, 111; 206/222; 215/228, 250

[56] References Cited

U.S. PATENT DOCUMENTS

| | | | |
|---|---|---|---|
| 2,073,273 | 3/1937 | Wetstein | 426/120 |
| 2,631,521 | 3/1953 | Atkins | 426/120 |
| 2,653,609 | 9/1953 | Smith | 206/222 |
| 2,721,552 | 10/1955 | Nosik | 206/222 |
| 2,766,755 | 10/1956 | Greene | 206/222 |
| 2,793,776 | 5/1957 | Lipari | 426/117 |
| 2,807,384 | 9/1957 | Lipari | 426/117 |
| 2,824,010 | 2/1958 | Pedersen | 426/120 |
| 3,098,575 | 7/1963 | Siebelt . | |
| 3,156,369 | 11/1964 | Bowes et al. | 206/222 |
| 3,220,588 | 11/1965 | Lipari | 206/222 |
| 3,305,368 | 2/1967 | Bourelle | 426/120 |
| 3,347,410 | 10/1967 | Schwartzman | 206/222 |
| 3,349,966 | 10/1967 | Schwartzman | 206/222 |
| 3,443,726 | 5/1969 | Muller et al. | 206/222 |
| 3,521,745 | 7/1970 | Schwartzman | 206/222 |
| 3,537,605 | 11/1970 | Solowey | 206/222 |
| 3,603,469 | 9/1971 | Magni | 206/222 |
| 3,743,520 | 7/1973 | Croner | 426/120 |
| 3,968,872 | 7/1976 | Cavazza | 206/222 |
| 4,221,291 | 9/1980 | Hunt | 206/222 |
| 4,247,001 | 1/1981 | Wiegner | 206/222 |
| 4,279,351 | 7/1981 | Vertes . | |
| 4,412,623 | 11/1983 | Schmidt | 426/117 |
| 4,706,827 | 11/1987 | Cabernoch et al. | 426/117 |
| 5,071,034 | 12/1991 | Corbiere | 206/222 |
| 5,114,033 | 5/1992 | Golias et al. . | |
| 5,542,528 | 8/1996 | Lanfronconi et al. . | |
| 5,772,017 | 6/1998 | Kang | 426/120 |

FOREIGN PATENT DOCUMENTS

| | | | |
|---|---|---|---|
| 2453793 | 12/1980 | France | 206/222 |
| 2729390 | 1/1979 | Germany | 426/120 |
| 1180059 | 2/1970 | United Kingdom | 426/120 |

*Primary Examiner*—Steven Weinstein
*Attorney, Agent, or Firm*—Salzman & Levy

[57] ABSTRACT

A flavor enhancing mechanism for bottled water, club soda, and bland liquid comestibles, is described. The flavor enhancing mechanism includes a bottle cap containing a flexible bellows. The bellows is generally transparently clear, flexible plastic. The bottle cap and bellows are mounted upon a bottle containing a liquid comestible, whose flavor is to be enhanced. The bellows contains concentrates of fruit juices and/or other natural flavors. The bottle cap is designed to be screw threaded or snap fitted onto the standard lip portion of glass or plastic drinking containers. Upon application of a downward force, the flavor enhancers are squeezed from the flexible bellows, and injected downwardly into the bland liquid substances held in the bottle.

4 Claims, 1 Drawing Sheet

INJECTOR BOTTLE CAP ASSEMBLY

FIELD OF THE INVENTION

The present invention relates to flavor enhancers for bottled water, club soda, and bland liquid comestibles and, more particularly, to a bottle cap that contains flavors for injection into these bland liquid comestibles.

BACKGROUND OF THE INVENTION

In recent times, a great variety of bland soft drinks, such as bottled waters, club sodas, and seltzers have been marketed to the general public. These drinks have a strong following with health conscious individuals, who tend to eschew sugars, additives, syrups, and food coloring. It has been determined that a great percentage of these health conscious individuals would prefer to have more taste in these bland drinks, if it were possible to control the flavor enhancing substances.

The present invention seeks to make bland drinks more palatable by providing a bottle cap containing healthy and nutritious flavor enhancers. The bottle cap comprises a transparently clear, flexible bellows mounted above a screw-on or snap-on cap. The bellows contains concentrates of fruit juices and/or other natural flavors. The flavors are devoid of sugars, salt, fillers, additives, food coloring, and other harmful substances. The bottle cap is designed to be screw threaded, or snap fitted onto the standard lip portion of glass or (more frequently) plastic drinking containers. Upon application of a downward force, the bellows is depressed and the flavor enhancers are squeezed from the flexible bellows and injected downwardly into the bland liquid substances (hereinafter referred to as "water") held in these containers.

The bellows is hermetically sealed by a thin membrane disposed in the bottom of the cap. The membrane provides sanitary containment of the flavored substances inside the bellows. The bottom seal of the bottle cap is broken when the cap is attached to the bottle of water. In an alternate embodiment, the seal can be broken by an internal plunger disposed in the middle of the bellows, which is forced downwardly when the bellows is compressed. Pressing downwardly against the bellows simultaneously breaks the seal and injects the flavors into the container.

A hard plastic safety cap surrounds the flexible bellows to prevent the bellows from being depressed until it is ready for use. The safety cap is removed after the flavor enhancing cap is attached to the liquid container. Operational instructions and nutritional information are printed upon the hard, smooth surface of the safety cap.

DISCUSSION OF RELATED ART

In U.S. Pat. No. 5,542,528, issued to Lanfranconi et al, on Aug. 6, 1996, for BOTTLE FOR PRESERVING IN A SEPARATED CONDITION SUBSTANCES TO BE MIXED TOGETHER BEFORE DISPENSING, a substantially rigid capsule is illustrated. A substance contained therein is subsequently mixed with a substance residing in a container to which it is attached. The capsule is designed to be inserted into the neck of the container. A plunger containing an upper diaphragm is disposed within the capsule, and operates as a separating layer between the liquids. The top portion of the capsule is flexible, and deforms under thumb pressure. The diaphragm and plunger are free to move downwardly upon the exertion of the thumb force upon the top of the capsule. The diaphragm engages a circular abutment. The liquid contained in the capsule is then free to flow downwardly under the force of gravity about the plunger and into the container. The liquid then mixes with the fluid held in the container.

By contrast, the injector cap of the invention comprises a bellows that is completely deformable. This complete deformability allows the flavoring fluid to be forcibly injected into the bottle below, rather than relying upon gravity feed. The injector cap of the invention also comprises a mechanism that has fewer parts.

In U.S. Pat. No. 5,114,033, issued to Golias et al, for APPARATUS FOR DISCHARGING CONTENTS OF A SEALED CONTAINER, a bellows is shown for attachment to an insertion tube. The insertion tube is disposed within a rubber stopper comprising a discharge tube outlet. The stopper is inserted into the neck of a test tube, or other container. Depression of the bellows forces air into the test tube, thus ejecting its liquid through the discharge tube outlet.

U.S. Pat. No. 3,098,575, issued to Siebelt on Jul. 23, 1963, for VACUUM SEAL CONTAINER CAP, illustrates a sealed container comprising a bellows seal. A stem attached to the bottom of the bellows is lifted to create a vacuum within the container.

In U.S. Pat. No. 4,279,351, issued to Vertes, on Jul. 21, 1981, for CONTAINER CAP, a flexible, bellows containing cap is illustrated. The bottom of the bellows compresses against pills or tablets contained in the vial to which the cap is attached. A full vial depresses the bellows a maximum amount, thus causing a restraining force against the pills contained within the vial. This prevents the pills from rattling about the vial during shipment. As the pills are subsequently used, the level of the tablets decreases, allowing the bellows to expand to meet the level of the pills, keeping them snugly housed within the vial.

SUMMARY OF THE INVENTION

In accordance with the present invention, there is provided a flavor enhancing mechanism for bottled water, club soda, and bland liquid comestibles. The flavor enhancing mechanism comprises a bottle cap containing a flexible bellows. The bellows generally comprises a transparently clear, flexible plastic. The bottle cap and bellows are mounted upon a bottle containing a liquid comestible, whose flavor is to be enhanced. The bellows contains concentrates of fruit juices and/or other natural flavors. The flavors are devoid of sugars, salt, fillers, additives, food coloring, and other harmful substances. The bottle cap is designed to be screw threaded or snap fitted onto the standard lip portion of glass or plastic drinking containers. Upon application of a downward force, the flavor enhancers are squeezed from the flexible bellows, and injected downwardly into the bland liquid substances held in these containers.

The bellows is hermetically sealed by a thin membrane disposed in the bottom of the cap. The membrane provides sanitary containment of the flavored substances inside the bellows. The bottom seal of the bottle cap is broken by the pressure exerted by the bellows when it is depressed. In an alternate embodiment, the seal can be broken by an internal plunger disposed in the middle of the bellows, which is forced downwardly against the seal, when the bellows is compressed. Pressing downwardly against the bellows simultaneously breaks the seal and injects the flavors into the container.

A hard plastic safety cap surrounds the flexible bellows to prevent the bellows from being depressed until it is ready for use. The safety cap is generally removed after the flavor enhancing cap is attached to the liquid container. It should be understood that, since the flavor enhancing cap is portable, a user may attach his or her cap to their own container or bottle. Moreover, the cap can be prepackaged with the container at the time of manufacture. Operational instructions and nutritional information are printed upon the hard, smooth surface of the safety cap.

It is an object of this invention to provide an improved flavor enhancing mechanism for attachment to bottles and vessels containing bland tasting liquids for human consumption.

It is another object of the invention to provide a flavor enhancing mechanism that can be attached easily to water bottles or other containers, and whose flavor enhancers are forcibly injected into the liquids of these bottles and containers.

It is a further object of this invention to provide a flavor enhancing mechanism for attachment to bottles and containers holding bland liquid comestibles, that is simple to manufacture and that is low in cost.

BRIEF DESCRIPTION OF THE DRAWINGS

A complete understanding of the present invention may be obtained by reference to the accompanying drawings, when considered in conjunction with the subsequent detailed description, in which.

For purposes of clarity and brevity, like elements and components will bear the same numbering and designation throughout the figures.

DESCRIPTION OF THE PREFERRED EMBODIMENT

Generally speaking, the invention features a flavor enhancing mechanism for bland soft drinks and other tasteless, bottled substances. The mechanism is attached to the bottle containing the bland substances. Concentrated flavor enhancing substances contained within the mechanism are then injected downwardly into the soft drink.

Figure 1:
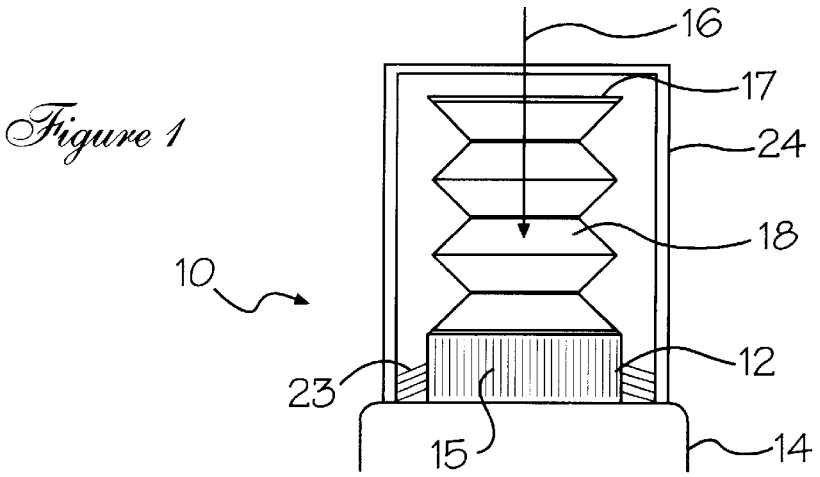
FIG. 1 illustrates a front, in situ view of the flavor enhancing mechanism of this invention.

Now referring to FIG. 1, the flavor enhancing mechanism 10 of this invention is illustrated. The mechanism comprises a cap 12, which is screw-threaded, or snap fitted onto the mouth 14 of a standard bottle of bland water, club soda, or soft drink. The cap 12 has an outer knurled surface 15 for tightly gripping the cap as it is attached to the bottle 14. Flavor enhancers 11 of the mechanism 10 are stored within a flexible, plastic, transparent bellows 18 that is attached to the cap 12, as observed in the cut-away view of FIG. 2. The bellows 18 is downwardly compressible (arrow 16), by placing one's thumb on the top portion 17 of the bellows 18, and pressing downwardly.

Figure 3:
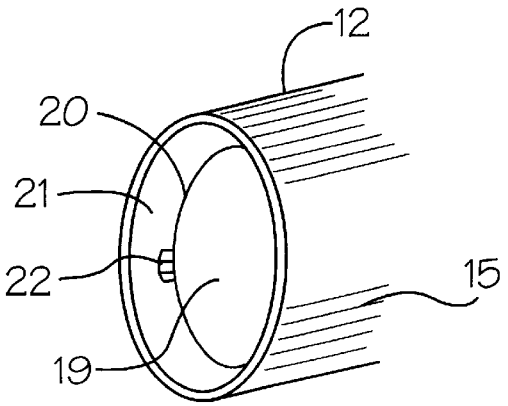
FIG. 3 shows a perspective view of the bottom seal of the flavor enhancing mechanisms depicted in FIGS. 1 and 2.

The flavor enhancers 11 comprise healthy concentrated substances, such as fruit juices, spices, and herbs. These flavor enhancers are injected into the bottle of water, soda, or other bland comestible liquid, when the bellows 18 is compressed. Moreover, these enhancing substances 11 are hermetically sealed within the bellows 18 by a non-porous membrane 19, attached within the cap 12, as shown in FIG. 3. The membrane 19 is loosely attached about its periphery 20 to the inner wall 21 of cap 12. When the bellows 18 is depressed, the pressure created upon the membrane 19 by the compressed flavor enhancing liquid, above, tears it away from the inner wall 21 of cap 12. Thus, the flavor enhancers 11 are released and injected into the bottle below. It may be helpful to break the vacuum of the bottle or the container 14 prior to actuating bellows 18. In order to prevent the membrane 19 from falling into the bottled substance below, the membrane 19 is affixed at its periphery to the cap 12, about a small welded portion 22. The force of the depressed bellows 18 tears away the membrane 19 from the inner wall 21 about its periphery 20, except for the welded portion 22.

A transparent, hard plastic, removable, safety top 24, is frictionally attached about cap 12, along its knurled surface 15 at attachment surface 23. The hard plastic top 24 protects the bellows 18 and its contents from being damaged or prematurely triggered. The safety top 24 is generally removed after the flavor enhancing cap 12 is attached to the liquid container 14. Operational instructions and nutritional information are printed upon the hard, smooth surface of the safety top 24.

Figure 2:
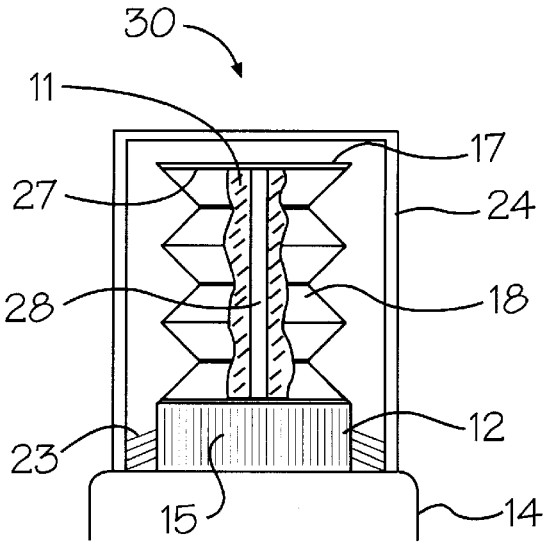
FIG. 2 depicts a front, cut-away, in situ view of an alternate embodiment of the flavor enhancing mechanism shown in FIG. 1.

Referring to FIG. 2, a second embodiment 30 of the flavor enhancing mechanism 10 is illustrated. The second embodiment is identical to the previously described mechanism 10, depicted in FIG. 1, except for a plunger 28, which is affixed to the underside 27 of the top portion 17 of bellows 18. In this embodiment, the plunger 28 is pushed into the membrane 19, thus adding a greater force for releasing the membrane 19 about its attachment with the inner cap wall 21, along its periphery 20.

Since other modifications and changes varied to fit particular operating requirements and environments will be apparent to those skilled in the art, the invention is not considered limited to the example chosen for purposes of disclosure, and covers all changes and modifications which do not constitute departures from the true spirit and scope of this invention.

Having thus described the invention, what is desired to be protected by Letters Patent is presented in the subsequently appended claims.

What is claimed is:

1. A bottle cap assembly for adding flavor enhancers to bottles containing comestible liquids, comprising:

a cap having an inner wall for attaching the bottle cap assembly to a mouth portion of a bottle containing a comestible liquid, said bottle cap assembly being attached to said bottle about said inner wall;

a compressible container attached to the top of said cap, said compressible container having a flavor enhancing substance stored therein, which flavor enhancing substance is released and injected into said bottle upon compressing said compressible container to enhance the flavor of said comestible liquid; and a membrane releasably affixed to said cap about substantially its entire inner wall except for a small portion thereof, said membrane hermetically sealing and holding said flavor enhancing substance within said compressible container until such time as said compressible container is compressed, said membrane being releasably affixed to said inner wall of said cap such that when the compressible container is compressed, the pressure created upon the membrane by the compressed flavor enhancing substance tears said membrane from said inner wall about substantially the entire periphery of said membrane to release and inject said flavor enhancing substance into said bottle, said membrane being welded at its periphery to the inner wall at said small portion thereof, such that after said compressible container is compressed, said portion of the membrane which is welded to the inner wall remains affixed thereto to prevent said membrane from being injected into said comestible liquid along with said flavor enhancing substance.

2. The bottle cap assembly for adding flavor enhancers to bottles in accordance with claim 1, wherein said compressible container comprises a flexible bellows.

3. The bottle cap assembly for adding flavor enhancers to bottles in accordance with claim 1, further comprising a hard plastic top temporarily attached to said bottle cap assembly.

4. The bottle cap assembly for adding flavor enhancers to bottles in accordance with claim 1, wherein said bottle cap assembly comprises a knurled surface disposed thereon.

* * * * *